United States Patent [19]

Pollinger et al.

[11] 3,958,513

[45] May 25, 1976

[54] AUTOMATIC FLUID MOTOR RAILWAY CAR RECHARGING

[75] Inventors: Hans Pollinger; Erich Huber; Pierre Baronnet, all of Munich; Walter Kugler, Puchheim-Bahnhof, all of Germany

[73] Assignee: Knorr-Bremse GmbH, Munich, Germany

[22] Filed: Mar. 29, 1974

[21] Appl. No.: 456,362

[30] Foreign Application Priority Data

Mar. 30, 1973 Germany ..... 2315949

[52] U.S. Cl. ..... 104/157; 104/158; 104/160; 105/65

[51] Int. Cl.[2] ..... B61B 13/12; B61C 7/02; B61C 8/00; B61C 17/06

[58] Field of Search ..... 105/63, 64 R, 65; 104/157, 158, 159, 160

[56] References Cited

UNITED STATES PATENTS 3,556,013 1/1971 Kruer et al. ..... 105/65 X

*Primary Examiner*—Robert J. Spar
*Assistant Examiner*—Howard Beltran
*Attorney, Agent, or Firm*—Edmund M. Jaskiewicz

[57] ABSTRACT

A railway vehicle having pneumatic actuated devices connected to a pneumatic system including a refillable supply tank connected to the control and actuation elements of the pneumatic devices is provided with a device for coupling the supply tank to a source of pressure medium as the vehicle approaches the source. The apparatus comprises a supply funnel on the vehicle connected to the supply tank and a supply nozzle connected to a source of pressure medium at a station. The supply nozzle is provided with receiver means. On the vehicle there is provided contact means which are engageable with the receiver means as the vehicle enters the station to align coaxially the funnel and nozzle and to impart relative longitudinal movement between the funnel and nozzle to couple these elements in tight coupled position. The funnel and nozzle are each provided with check valves which are opened simultaneously upon coupling of the funnel and nozzle.

9 Claims, 5 Drawing Figures

AUTOMATIC FLUID MOTOR RAILWAY CAR RECHARGING

The present invention relates to a vehicle such as a railway vehicle equipped with pneumatic devices connected to a pneumatic system including at least one refillable supply tank, more particularly, to an apparatus for coupling the supply tank to a source of pressure medium as the vehicle approaches the source located in a station.

Various forms of railway vehicles have been equipped with pneumatic devices including braking, coupling and/or door operating devices. In particular, self-propelled railway vehicles primarily intended for passengers have been so equipped and these vehicles are constructed so as to operate individually or they can be coupled together to operate as a train of vehicles. Such vehicles are generally equipped with compressors to provide a supply of compressed air to the air supply tank connected to the compressed air circuit for operating the pneumatic devices. It has been desired to eliminate compressors as a source of compressed air but to provide a supply of air which would enable the pneumatic devices of the vehicle to operate to their full extent during a normal period of operation. The elimination of the compressors would not only significantly decrease the weight of the vehicles which are initially constructed as light as possible but would simplify the structure of the pneumatic circuit.

It has been known to drive vehicles by various forms of combustible gases which are obtained from a liquefied gas contained in a pressurized container and so mounted on a vehicle so as to be replaceable when they are emptied. It would be too expensive and too complicated to provide a tank filled with compressed air in a similar interchangeable relationship. Further, the relatively high consumption of compressed air for braking functions and for the operating of doors would require containers of such a high capacity that such size containers would not be feasible for such an interchangeable operation.

It is therefore the principal object of the present invention to provide an apparatus for facilitating the filling of such supply tanks on vehicles from a source of pressure medium as the vehicle approaches the source.

It is another object of the present invention to provide such an apparatus which coaxially aligns and couples a supply nozzle at a source of pressure medium with a supply funnel on the vehicle as the vehicle comes to a stop at the source of pressure medium.

It is a further object of the present invention to provide such an apparatus which is simple in construction and effective and reliable in operation.

The present invention is particularly adapted for a vehicle such as a railway vehicle having pneumatic actuated devices connected in a pneumatic system including a refillable supply tank connected to the control and actuation elements of the pneumatic devices. According to one aspect of the present invention an apparatus for coupling the vehicle supply tank to a source of pressure medium as the vehicle approaches the source may comprise a supply funnel connected to the vehicle supply tank and having a check valve therein. A supply nozzle is connected to a source of pressure medium at a station which is approached by the vehicle and a check valve is also provided in the nozzle. The supply nozzle is provided with receiver means. On the vehicle there is provided contact means which is engageable with the receiver means as the vehicle enters the station. The engagement of the contact and receiver means aligns coaxially the funnel and nozzle and imparts relative longitudinal movement between the funnel and nozzle to couple the funnel and nozzle in tight coupled position. The coupling of the funnel and nozzle simultaneously opens the check valves.

Other objects and advantages of the present invention will be apparent upon reference to the accompanying description when taken in conjunction with the following drawings, which are exemplary, wherein.

Proceeding next to the drawings wherein like reference symbols indicate the same parts throughout the various views a specific embodiment and modifications of the present invention will be described in detail.

Figure 1:
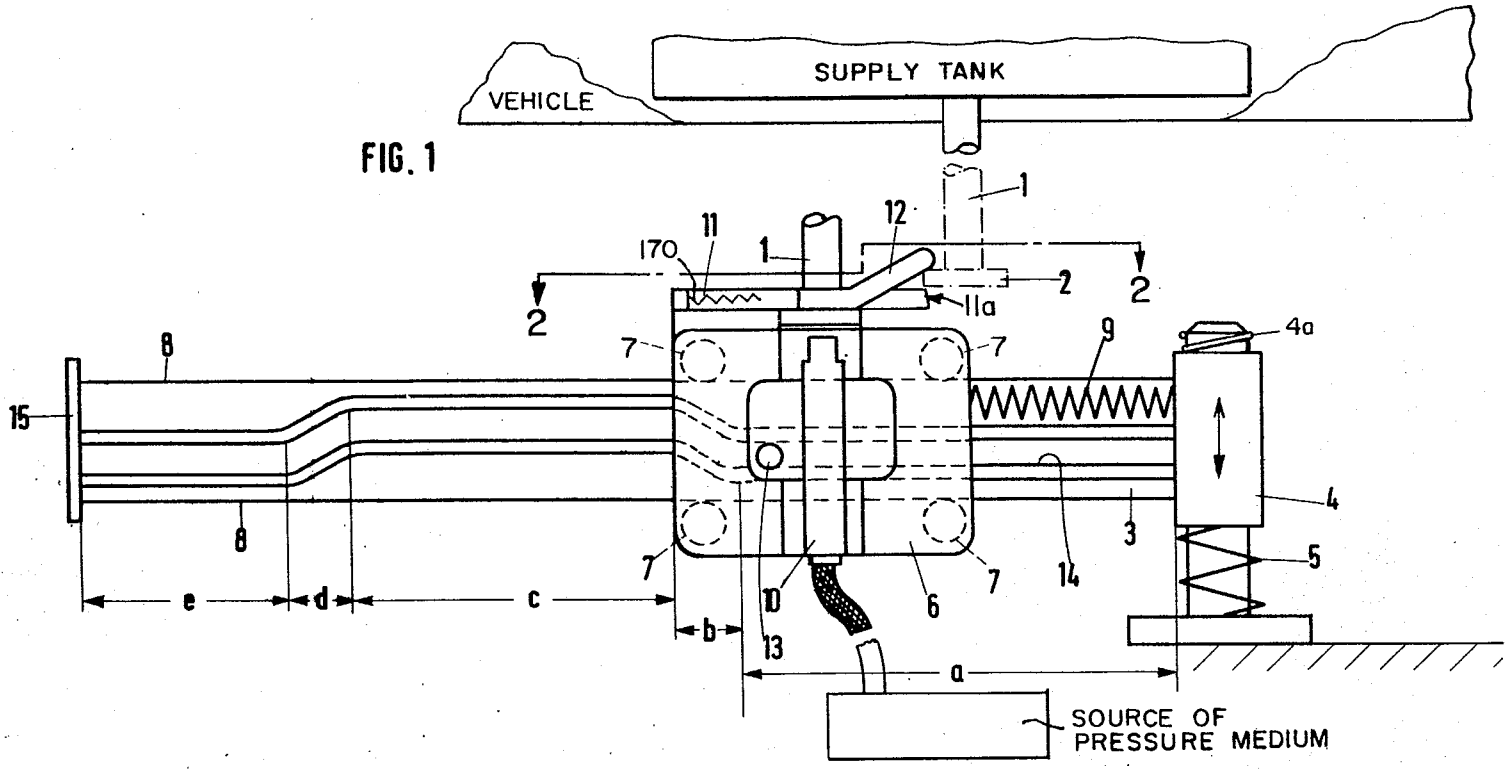
FIG. 1 is a side elevational view of one embodiment of the present invention showing the moveable carriage mounted on the horizontal carrier bracket.

In FIG. 1 there is illustrated an embodiment of the invention in which an outside source of auxiliary energy is not required to control the coupling operation. A vehicle 16 is provided with a supply tank 60 connected to a pneumatic brake (FIG. 3) and to which is connected a supply funnel 1 provided with a catching head 2 in the form of an external flange. The funnel 1 is rigidly mounted on the vehicle and is connected to the supply tank through a known type of check valve which is not illustrated.

At the station or other stopping point for the vehicle there is mounted a horizontal carrier bracket 3 within the stopping range of the vehicle and extending in the direction of travel of the vehicle. The bracket is pivotably mounted on a vertical pin 4 and is also axially displaceable on this pin. Spring means **4*a* are provided to return the carrier bracket 3 to its initial predetermined position and a spring 5 is provided to return the bracket vertically to its initial position. The carrier bracket 3 is mounted for pivotal movement in a horizontal plane since certain vehicles on railways may travel into a station with a tolerance of approximately ± 1.97 in. (50mm) along a line transversely to the direction of travel. The moveability of the carrier bracket 3 in a vertical direction is required since the level of the supply funnel 1 on vehicles in a station may vary with the load of the vehicle with respect to the supply nozzle 10** by, for example, ± 0.79 in. (20mm). The horizontal pivoting and vertical displacement of the carrier bracket is accomplished against resilient restoring forces so that the carrier bracket will automatically return into its starting position after the supply nozzle has been uncoupled from a supply funnel.

A carriage 6 is slideably mounted for longitudinal or horizontal displacement on the carrier bracket 3 and is provided with a roller element 7 that runs along the longitudinal edges 8 of the bracket 3. From its initial or normal position which is in the vicinity of the pin 4, the carriage 6 can be displaced in the direction of travel of the vehicle against the force of a spring 9. A supply nozzle 10 is mounted on the carriage 6 with its axis perpendicular to the direction of travel of the vehicle and substantially parallel with the axis of supply funnel 1.

The slideable carriage 6 is provided on its upper surface with a receiver or catching device 11*a* comprising an arm 11 pivotably mounted at 160 and maintained in the receiving position by a spring 170. The outer end of the arm 11 is upwardly and outwardly bent as may be seen from FIGS. 1 and 2 to form a catching portion 12.

Figure 2:
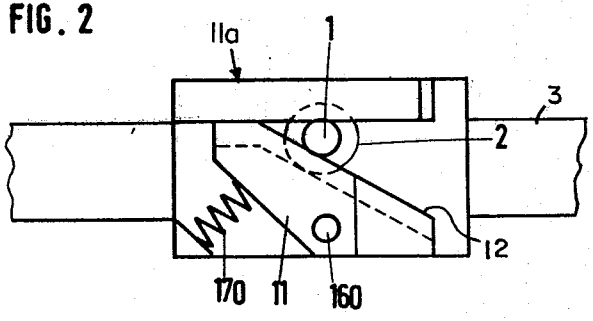
FIG. 2 is a top plan view of the moveable carriage shown in FIG. 1 looking in the direction of the line 2—2.

As the vehicle provided with supply funnel 1 approaches a station, the catching portion 12 engages behind catching head 2 of the supply funnel 1 to guide the head along these jaws as shown in FIG. 2 into the proper coaxially aligned position with respect to the filling nozzle 10 on the carriage 6.

The carriage 6 will be carried along by the vehicle by further movement of the vehicle toward its stopped position. The catching portion 12 slides along the projecting edges of the catching head 2 and the carrier bracket 3 is pivoted around the axis of pin 4 and shifted axially into a receiving position in which the axes of the funnel 1 and nozzle 10 are coaxially aligned.

FIG. 1 illustrates the beginning of the catching process wherein the catching portion 12 extends behind catching head 2 of funnel 1 which is shown in the dot-dash lines. FIG. 1 also shows in solid lines the position of the supply funnel with respect to the nozzle 6 upon completion of the catching operation.

For purposes of clarity, the supply funnel 1 is illustrated as being axially shifted in the two different positions of the catching operation. However, it is clear from the foregoing description of the operation that the funnel is attached rigidly to the vehicle and the carrier bracket 3 together with the sliding carriage 6 is to be considered as being axially displaced by a suitable distance during the above discussed catching operation.

The supply nozzle 10 which is axially displaceable on the sliding carriage 6 is provided with a cam pin 13 that engages a curved guide surfaces 14 on the carrier bracket 3. The guide surfaces 14 are provided with a section *a* that is parallel with the direction of movement of the carriage 6 so that when the carriage is moved by a vehicle approaching the station the supply nozzle 10 will remain in its illustrated retracted position within section *a*. Next, the guide surfaces ascend in section *b* which then proceeds into section *c* which again is parallel with the direction of movement of the carriage. The guide surface then descends in section *d* to a section *e* which is at the level of initial section *a* and the guide surface is once again parallel with the direction of movement of the carriage up to its stop 15.

As the vehicle comes into a station, the vehicle stops within section *c* while the above described catching operation occurs within section *a*. The length of section *c* for the guide surfaces 14 will depend upon the range within which the vehicle comes to a stop in a particular station and, for example, may be ± 0.98 foot (0.3 meters). Subsequent movement of carriage 6 in the direction of travel in the vehicle within section *b* will shift the supply nozzle 10 axially. This axial shifting will cause the front end of the supply nozzle 10 to be inserted into supply funnel 1 and the result will be a pressure tight coupling. Simultaneously with this axial displacement and coupling check valves provided in both the supply nozzle and the supply funnel (not illustrated) are pushed open to enable the air to be admitted from a source connected to the supply nozzle to be admitted to the refillable tank connected to the funnel 1. The duration of this filling period is so determined that it will be completed in time before the vehicle leaves the station.

As the vehicle begins moving to leave the station the slide carriage 6 will be carried along until it abuts stop 15 where it will be held in position. The movement of carriage 6 through section *d* into section *e* of the guide surfaces 14 will axially retract the supply nozzle 10 back to its initial position. As the nozzle descends when passing over section *d* the spring loaded check valves in both the supply funnel and supply nozzle are again closed. Since the funnel 1 is held rigidly on the vehicle the arm 11 will be pivoted about its axis 160 against the force of spring 170 so that the funnel with its head 2 will pass through by the pivoted arm to be released. The holding force of the spring mounted arm 11 of the receiving means is exceeded when the carriage abuts stop 15 and vehicle is moving away from the station to release catching head 2. Upon release of the carriage 6 from the supply funnel 1 the spring 9 will return the carriage into its initial position where it is ready for another coupling of the supply nozzle with a supply funnel.

It is therefore apparent that the supply nozzle is brought into a coaxially coupling relationship with the supply funnel by the displacing of the carriage along the carrier bracket by the movement of the vehicle and, depending upon the position of the vehicle with respect to the right of way, the carrier bracket is at the same time pivoted horizontally and/or displaced vertically to permit alignment of the nozzle and funnel.

It is to be noted that the coupling and refilling apparatus as described above operates without any external or auxiliary sources of energy. However, it is also within the scope of this invention to provide for feeding the supply nozzle into coupling position with the supply funnel not only by cam surfaces but by pistons controlled by a pressure medium. In such an embodiment, the curved guide surfaces may be employed for controlling the valves acting on pistons. Further, such valves can also be controlled electrically by means of limit or microswitches properly positioned on the carrier bracket.

It is also apparent that the embodiment of FIGS. 1 and 2 can be modified by mounting the sliding carriage 6 on a relatively short pivotally and axially displaceable bracket or arm. In such a modification the supply funnel would be positioned in a corresponding manner longitudinally displaceable along a guide on the vehicle. An appropriate bracket could be mounted in a fixed position if the supply funnel is not only guided longitudinally but also provided with the possibility of axial movement so as to be able to be pulled downwardly into coupling relation with the supply nozzle during the catching operation.

Figure 3:
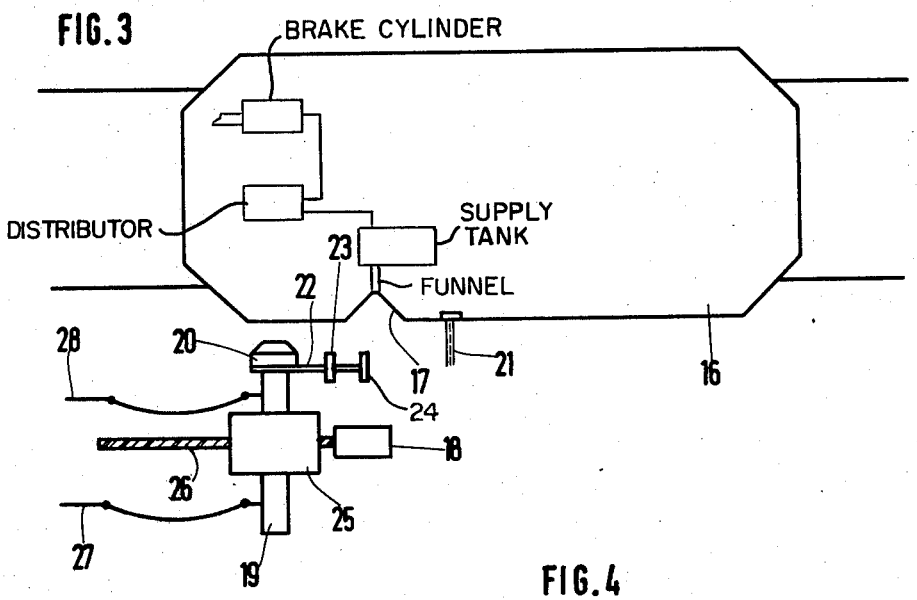
FIG. 3 is a top plan view of a railway vehicle and a modification of the device of the present invention.

In FIG. 3 there is illustrated a further modification wherein the vehicle is indicated schematically at 16 and is provided with a supply funnel 17 on an outer surface thereon and is further provided with feed or displacing means 18, 19 for a supply nozzle 20 which is to be coupled to the supply funnel. An electrical contact arm 21 is mounted on the vehicle in the vicinity of the funnel 17. Two electrical contact fingers 23 and 24 are mounted on the cross-mounted member 22 extending from the supply nozzle 20 and are spaced in the direction of travel of the vehicle. The supply nozzle 20 with its feed mechanism 19 is supported on a frame 25 that can be displaced in the direction of travel of the vehicle by means of a spindle shaft 26. The spindle shaft is driven by a stepping motor as known in the art. The feed device comprises a cylinder that can be acted upon transversely to the direction of travel through a control pressure line 27. When the supply nozzle 20 is coupled in a pressure tight sealed relationship with the supply funnel 17 a supply tank in the car 16 is filled through a main pressure medium line 28.

Coupling of the nozzle 20 to the funnel 17 occurs in the following sequence:

The supply nozzle 20 having displacing and feed devices 18, 19 is located within the area of a station wherein the car 16 will be brought to a stop. If neither of the contact fingers 23, 24 is contacted by the contact arm 21, a logic circuit, which is not illustrated and which is connected to the contact arm 21 and contact fingers 23, 24 releases a signal to feed device 18 for moving the supply nozzle 20 to the left as viewed in the drawings until the contact arm 21 passes over contact finger 24 but without also passing over contact finger 23. The nozzle 20 is then in the correct position for coupling with the funnel 17. By supplying pressure medium to the feed device 19 the nozzle 20 is moved axially into coupling relationship with the funnel 17.

Funnel 17 and nozzle 20 may be mounted for movement in all directions such as by being suspended on gimbals by means of a universal joint support so that all possible levels and transverse tolerances of the funnel 17 with respect to the nozzle 20 may be readily compensated for during the coupling operation. The nozzle 20 and the funnel 17 are both provided with guide surfaces that are not illustrated in the drawings. A relative displacement of the coupling elements occurs along such guide surfaces simultaneously with reciprocal alignment. As described above, both the nozzle 20 and funnel 17 are each provided with check valves which are opened when the nozzle and funnel are in the coupled position.

When the operation of supplying air or pressure medium to the refillable tank on car 16 has been completed, a signal is released, either automatically or from the operator's controls, to the feed device 19 which moves the nozzle 20 axially away from funnel 17 to uncouple these members before the vehicle begins to leave the station. Further, this release operation may be followed by another signal to the feed device 18 which returns the released nozzle 20 to its initial position. The check valves in the nozzle and funnel will be closed automatically through spring force during the release and uncoupling operation.

In the event the vehicle 16 entering the station should stop in a position wherein only contact finger 24 is passed over by the contact arm 21, the nozzle 20 is then automatically located in the proper position for coupling without the necessity for any further adjustment. However, if both contact fingers 24, 23 are passed over by arm 21 as the vehicle approaches and stops in the station, the logic circuit releases a signal to the displacing device 18 to shift the nozzle 20 in the direction of travel of the vehicle until contact arm 21 passes over contact 23 without however also passing over contact 24. The nozzle 20 will then be located in the proper coupling position with respect to funnel 17.

Should the displacing device advance the nozzle to such an extent that contact finger 24 is also passed over by contact arm 21 the logic circuit will release a signal that the nozzle 20 has been advanced too far and must be returned until the arm 21 is stopped between the contact fingers, i.e., such that only a single contact finger is passed over by the contact arm in a single direction of travel.

Figure 4:
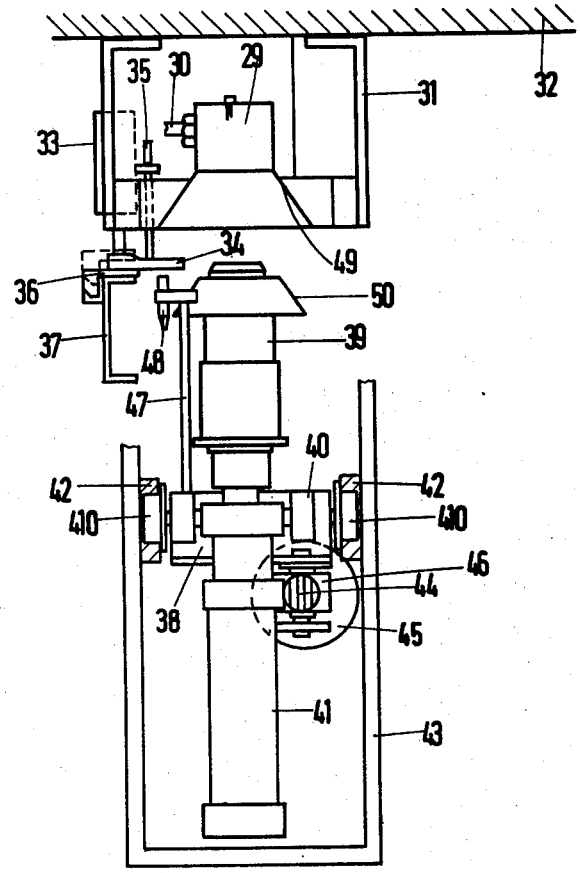
FIG. 4 is a front elevational view parallel to the direction of travel of the railway vehicle and a further modification thereof.
Figure 5:
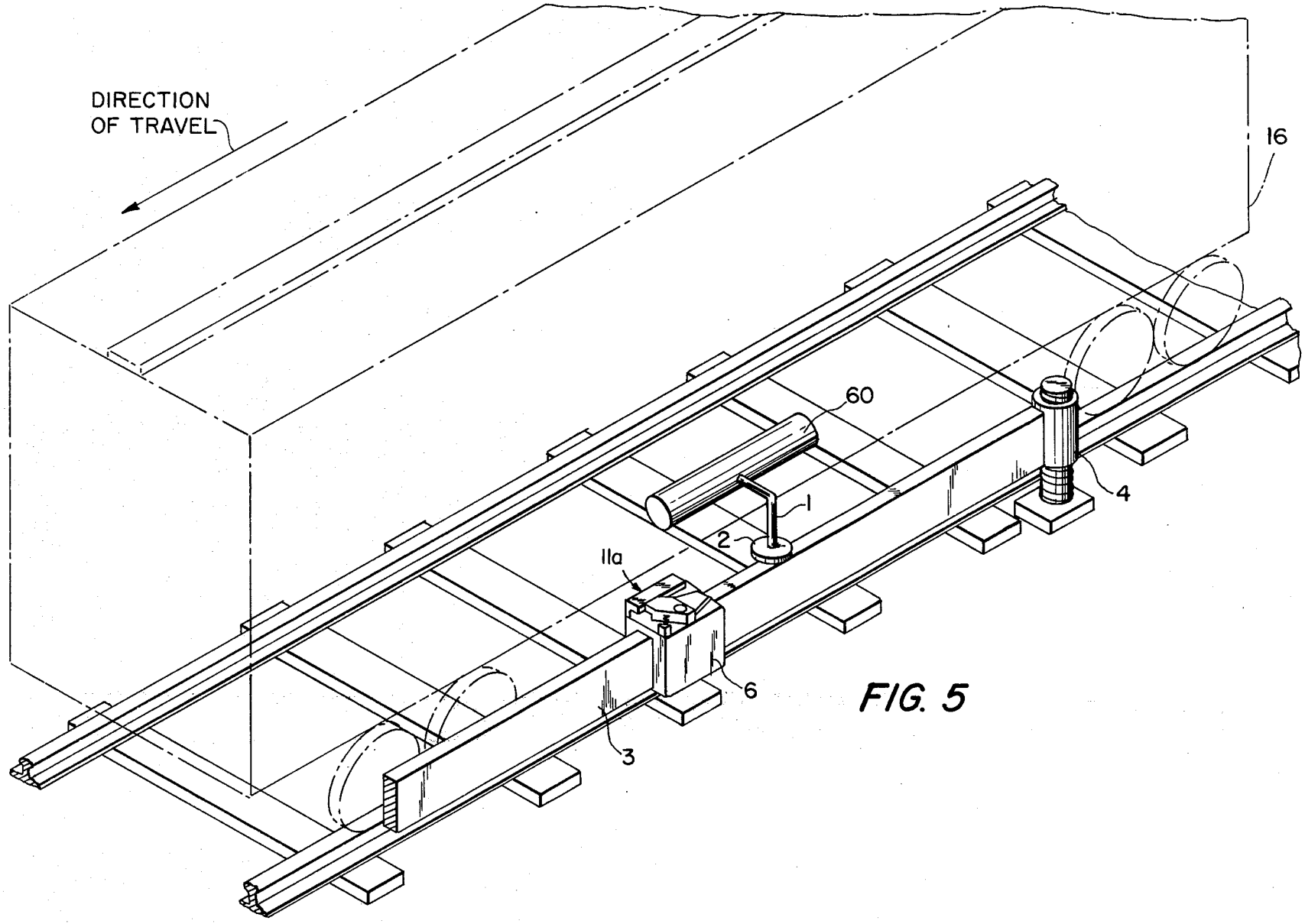
FIG. 5 is a perspective view of a railway vehicle having a supply reservoir which can be filled by the device as shown in FIG. 1.

In FIG. 4 there is shown a further modification of the present invention is which a supply funnel 29 to which is connected a pipe or tube 30 is mounted on the underside of a railway vehicle of the self-propelled or other type. The funnel 29 is mounted in a cardan suspension 31. Outside of suspension 31 on a vehicle frame 32 there is mounted a cylinder 33 with which it is possible to switch a contact arm 34 which is provided with electrical connection 35 to a circuit that is not illustrated. The contact arm 34 is relatively wide so that irrespective of the particular position of the vehicle transversely to the direction of travel in the stop position, the stationary contact receiver 36 which is in the form of a strip or bar assures contact by the arm 34 when the cylinder 33 is displaced outwardly.

The receiver bar 36 which is shown in front elevation in FIG. 4, extends in the direction of travel through a plane which at least corresponds to the length of the stopping range within which the contact 34 of a vehicle stopping in a station is located. The receiver strip 36 is mounted on a frame 37 on the right-of-way below the vehicle and can be pressed by the outwardly displaced contact 34 from a switched-off position indicated by dashed lines against spring forces into the illustrated switched-on position from which it returns automatically into the switched-off position when released by the switching pressure.

A supply nozzle 39 is mounted in a cardan suspension 40 on a sliding carriage 38. In FIG. 4, the supply nozzle 39 is positioned ready for coupling. Also mounted on slide carriage 38 is an adjusting device which consists of a cylinder 41 which can be subjected to the action of a pressure medium and has connections for a control pressure line for displacing nozzle 39 forwardly into a coupled position in supply funnel 29, but these connections are not illustrated.

Between the supply nozzle 39 and adjusting cylinder 41 and on both sides thereof the carriage comprises a pair of axles with wheels of which a wheel pair 410 may be seen in FIG. 4. The four wheels of the carriage run in two channel-shaped rail type guides 42 that extend parallel with the direction of travel of the vehicle and are mounted in a fixed frame 43 that is anchored firmly on the right-of-way of the vehicle. The sliding carriage frame is engaged by a spindle 44 of a spindle drive 45 for the purpose of displacing slide carriage 38 along guides 42. The spindle drive 45 with its spindle 44 is illustrated in FIG. 4 in a front elevational view. Consequently, the axis of the spindle 44 extends perpendicularly to the axis of the adjusting cylinder 41. The spindle 44 extends below slide carriage 38 to the entire horizontal path displacement of the sliding carriage. A spindle nut 46 is held on slide carriage 38 and this nut meshes with the spindle shaft 44.

Exteriorly of the cardan suspension 40 a fixed mount 47 for a position indicator 48 is mounted on the slide carriage frame 38. In an axial direction with respect to a certain position on the vehicle the position indicator 48 releases a signal to a circuit for switching off the forward drive of spindle drive 45 which signal is followed after a predetermined time interval by a signal for the action to be exerted on cylinder 41 for shifting the nozzle 39 forwardly, or upwardly as viewed in the drawing, into the coupling position.

Funnel 29 and nozzle 39 are provided with correspondingly shaped guide surfaces 49, 50 respectively, along which the nozzle and the funnel which are suspended for universal movement slide reciprocally into a mutually centered position. A check valve, not shown, is mounted in the vicinity of the opening of the nozzle 39 and in the coupling position. This valve is pushed open against a spring force by a push rod when filling a supply funnel 29. When the coupled nozzle and funnel are released the check valve returns automatically into its closed position. The funnel 29 also contains a check valve, not illustrated, that is moved into the open position through the pressure of the pressure medium flowing from the supply nozzle 39. An electric contact pin 52 may be located on the supply funnel 39 which pin is actuated in the coupled position. The pin is electrically connected to the control cirucit and prevents any travel of the vehicle while the nozzle and funnel are coupled. Thus, the vehicle cannot be started when the nozzle and funnel are coupled.

The position indicator 48 may comprise any suitable mechanical, optical or magnetic device which in a certain position will release a signal to a circuit for controlling the spindle drive. The circuit contains a timing element by means of which the cylinder 41 for advancing nozzle 39 is subjected to the action of pressure to solenoid valves that are not illustrated and are connected into the circuit after spindle drive 45 is stopped.

Cylinder 33 for moving the contact 34 in and out may be pressure controlled as a function of the filling pressure of the tank in the vehicle which is to be filled. The signal for moving back the supply nozzle 39 while closing simultaneously the check valves may be released through from the operator's control panel through solenoid valves, that are not illustrated, and that are connected to the circuit. The cylinder 41 will be subjected to the pressure in the opposite direction by such solenoid valves for the purpose of the return stroke. The cylinder may also contain a spring so that only a forward stroke or a return stroke is pressure medium controlled.

It is therefore apparent that the present invention discloses several solutions for the problem of locating the supply nozzle into a position ready for coupling in coaxially alignment with the supply funnel. The supply funnel may be positioned so as to be axially or telescopically displaceable and can be moved into coupling position on the nozzle by a receiving device. The supply nozzle is thus located on a sliding carriage that moves in the direction of travel of the vehicle upon a stationary non-movable carrier bracket. On the other hand, the supply funnel may be mounted fixedly on the vehicle and a supply nozzle is guided to the funnel by means of the receiving device. This construction is available when it is desired to eliminate from the vehicle as much as possible expensive mechanical devices that otherwise would not be required.

Both of these described embodiments do not require an external or auxiliary source of energy. The present invention also discloses a modification wherein an external source or a plurality of such sources of energy is provided for coupling the supply nozzle to the supply funnel. For this purpose there is provided a feed device for shifting the supply nozzle in the direction of travel of the vehicle and a second feed device for shifting the supply nozzle perpendicularly to the direction of travel of the vehicle into coupling position with the supply funnel. A contact arm on the vehicle engages contact members or receivers on a reciprocal switching element of a switching device in a control circuit for controlling the feed devices. The nozzle and funnel are suspended for universal movement and corresponding guide surfaces are provided on the nozzle or funnel for automatic alignment of the longitudinal axis of the nozzle and funnel into a coaxial position.

It will be understood that this invention is susceptible to modification in order to adapt it to different usages and conditions, and accordingly, it is desired to comprehend such modifications within this invention as may fall within the scope of the appended claims.

What is claimed is:

1. In a vehicle, particularly a railway vehicle, having pneumatic actuated devices connected to a pneumatic system including a refillable supply tank connected to the pneumatic devices, an apparatus for coupling and uncoupling the vehicle supply tank to a source of pressure medium while the vehicle approaches the source in a direction of travel and comprising a supply funnel connected to the vehicle supply tank, a supply nozzle connected to a source of pressure medium at a station and moveable in said direction of travel, receiver means at said supply nozzle, and contact means on said vehicle engageable with said receiver means as the vehicle enters the station and approaches the source of pressure medium for aligning coaxially said funnel and nozzle during movement of the vehicle and for imparting relative longitudinal movement between said funnel and nozzle after the funnel and nozzle are aligned to couple said funnel and nozzle.

2. In a vehicle as claimed in claim 1 and comprising a carrier bracket, a carriage slideable on said carrier bracket and horizontally displaceable thereon, said nozzle and receiver means mounted on said carriage and engageable by said contact means as the vehicle enters the station, said carrier bracket so shaped to move the engaged receiver means and contact means to couple the funnel and nozzle as the vehicle comes to a stop.

3. In a vehicle as claimed in claim 2 wherein said carrier bracket is pivotably mounted on a vertical axis and is axially displaceable thereon, and means for returning said pivotable and displaceable carrier bracket to an initial predetermined position.

4. In a vehicle as claimed in claim 2 wherein said carrier bracket extends in the direction of travel of the vehicle, said nozzle is displaceable on said carriage in a direction perpendicular to said vehicle direction of travel.

5. In a vehicle as claimed in claim 2 and comprising guide surface means on said carrier bracket and so shaped to guide positively the carriage and nozzle as the carriage moves thereon.

6. In a vehicle as claimed in claim 1 wherein said receiver means comprises a spring-loaded arm which retains said contact means and opens when the force of the spring is exceeded to uncouple said funnel from said nozzle.

7. In a vehicle as claimed in claim 1 wherein said funnel is on the underside of the vehicle.

8. In a vehicle as claimed in claim 1 means operatively connected to said nozzle for displacing said nozzle in the direction of vehicle travel, feed means operatively connected to said nozzle for displacing said nozzle perpendicularly to the direction of vehicle travel into coupling position with said funnel, and means for suspending one of said funnel and nozzle for movement transverse to the direction of travel of the vehicle, and cooperating guide surfaces on said nozzle and funnel to align coaxially said nozzle and funnel.

9. In a vehicle as claimed in claim 8 and gimbal means for suspending at least one of said funnel and said nozzle.

* * * * *